US008872759B2

(12) United States Patent
Chang

(10) Patent No.: US 8,872,759 B2
(45) Date of Patent: Oct. 28, 2014

(54) WRITING APPARATUS FOR AN ELECTRONIC PAPER

(75) Inventor: Yao-Tsung Chang, New Taipei (TW)

(73) Assignee: Winstron Corporation, New Taipei (TW)

( * ) Notice: Subject to any disclaimer, the term of this patent is extended or adjusted under 35 U.S.C. 154(b) by 190 days.

(21) Appl. No.: 13/279,590

(22) Filed: Oct. 24, 2011

(65) Prior Publication Data

US 2012/0098803 A1 Apr. 26, 2012

(30) Foreign Application Priority Data

Oct. 25, 2010 (TW) ..... 99136307 A

(51) Int. Cl.
*G09G 3/34* (2006.01)

(52) U.S. Cl.
CPC ..... *G09G 3/344* (2013.01); *G09G 2370/08* (2013.01)
USPC ..... 345/110; 345/204

(58) Field of Classification Search
CPC ..... G09G 3/344; G09G 2370/08
USPC ..... 345/204, 108, 110, 173
See application file for complete search history.

(56) References Cited

U.S. PATENT DOCUMENTS

| | | | | |
|---|---|---|---|---|
| 7,675,511 | B2 | 3/2010 | Hattori | |
| 2003/0122761 | A1 | 7/2003 | Hong | |
| 2008/0018634 | A1 * | 1/2008 | Yeo et al. | 345/210 |
| 2009/0153496 | A1 * | 6/2009 | Kurihara et al. | 345/173 |
| 2009/0295710 | A1 | 12/2009 | Shimodaira | |
| 2011/0012907 | A1 * | 1/2011 | Sakamoto et al. | 345/555 |
| 2011/0260987 | A1 | 10/2011 | Zhao et al. | |

FOREIGN PATENT DOCUMENTS

| | | |
|---|---|---|
| CN | 101866200 | 2/2007 |
| CN | 1914554 A | 10/2010 |

OTHER PUBLICATIONS

Office Action issued in corresponding Taiwanese Application No. 099136307 on Jan. 13, 2014 with partial English-language translation.

Office Action issued in corresponding Chinese Application No. 201010526191.7 on Sep. 3, 2013 with partial English-language translation.

Non-final Office Action issued in corresponding U.S. Appl. No. 14/044,062 on Dec. 4, 2013.

* cited by examiner

*Primary Examiner* — Chanh Nguyen
*Assistant Examiner* — Tsegaye Seyoum
(74) *Attorney, Agent, or Firm* — Nixon & Vanderhye P.C.

(57) ABSTRACT

A writing apparatus for performing a writing operation on an electronic paper includes a writing controller and a pixel array writing unit. The writing controller includes a data driving unit for providing a plurality of data signals, and a scan driving unit for providing a plurality of scan signals. The pixel array writing unit is coupled electrically to the data driving unit and the scan driving unit, and is adapted to be disposed to confront a first planar side of the electronic paper for performing the writing operation on the electronic paper as controlled by the writing controller, where the data signals are written into the electronic paper with reference to the scan signals so as to enable the electronic paper to display a corresponding image.

7 Claims, 4 Drawing Sheets

WRITING APPARATUS FOR AN ELECTRONIC PAPER

CROSS REFERENCE TO RELATED APPLICATION

This application claims priority of Taiwanese application no. 099136307 filed on Oct. 25, 2010, the disclosure of which is incorporated herein by reference.

BACKGROUND OF THE INVENTION

1. Field of the Invention

The invention relates to a writing apparatus, more particularly to a writing apparatus for an electronic paper.

2. Description of the Related Art

Flat panel displays (FPDs) have the advantages of being light-weight, compact, power-saving, and low in radiation, etc., and are therefore widely used in electronic devices, such as computer monitors, mobile phones, personal digital assistants (PDAs), flat-panel televisions, multimedia devices, etc. In recent years, electronic paper, one type of which is known as electrophoretic display (EPD), has been developed to be a display that is even more power-saving, light-weight and compact, and that is flexible and more easily portable.

Referring to FIG. 1, a conventional electronic paper 900 includes a pixel array module 910 including a plurality of pixel units 911, and a built-in writing controller module 920. The writing controller module 920 drives the pixel array module 910 to display an image according to an image input signal. The writing controller module 920 includes a data driving unit 921 for providing a plurality of data signals, and a scan driving unit 922 for providing a plurality of scan signals. The data signals are written into the pixel units 911 in sequence as controlled by the scan signals in order to display the image.

With the writing controller module 920 built into the conventional electronic paper 900, it is difficult to lower the cost and to enhance the flexibility thereof. As such, application of the conventional electronic paper 900 is relatively limited.

SUMMARY OF THE INVENTION

Therefore, the object of the present invention is to provide a writing apparatus adapted for performing a writing operation on an electronic paper.

A writing apparatus for performing a writing operation on an electronic paper according to the present invention comprises a writing controller and a pixel array writing unit.

The writing controller includes a data driving unit for providing a plurality of data signals, and a scan driving unit for providing a plurality of scan signals. The pixel array writing unit is coupled electrically to the data driving unit and the scan driving unit, and is adapted to be disposed to confront a first planar side of the electronic paper for performing the writing operation on the electronic paper as controlled by the writing controller, where the data signals are written into the electronic paper with reference to the scan signals so as to enable the electronic paper to display a corresponding image.

Another object of the present invention is to provide a writing apparatus adapted for performing a writing operation on an electronic paper that includes a plurality of writing control electrodes. The writing apparatus comprises a writing controller and a device connecting port.

The writing controller includes a data driving unit adapted for providing a plurality of data signals to the writing control electrodes of the electronic paper, and a scan driving unit adapted for providing a plurality of scan signals to the electronic paper. The data signals are written into the writing control electrodes of the electronic paper with reference to the scan signals so as to enable the electronic paper to display a corresponding image.

The device connecting port is coupled electrically to the data driving unit and the scan driving unit, and serves as an interface for connecting with an electronic paper connecting port of the electronic paper such that the data signals and the scan signals are fed into the electronic paper.

The advantages of the present invention lie in that by using the writing apparatus of the present invention, the electronic paper may form a display device without requiring a built-in writing controller, such that the fabrication cost for such display devices can be significantly reduced, and the flexibility of such display devices can be enhanced.

BRIEF DESCRIPTION OF THE DRAWINGS

Other features and advantages of the present invention will become apparent in the following detailed description of the embodiments with reference to the accompanying drawings, of which.

DETAILED DESCRIPTION OF THE PREFERRED EMBODIMENTS

Figure 1:
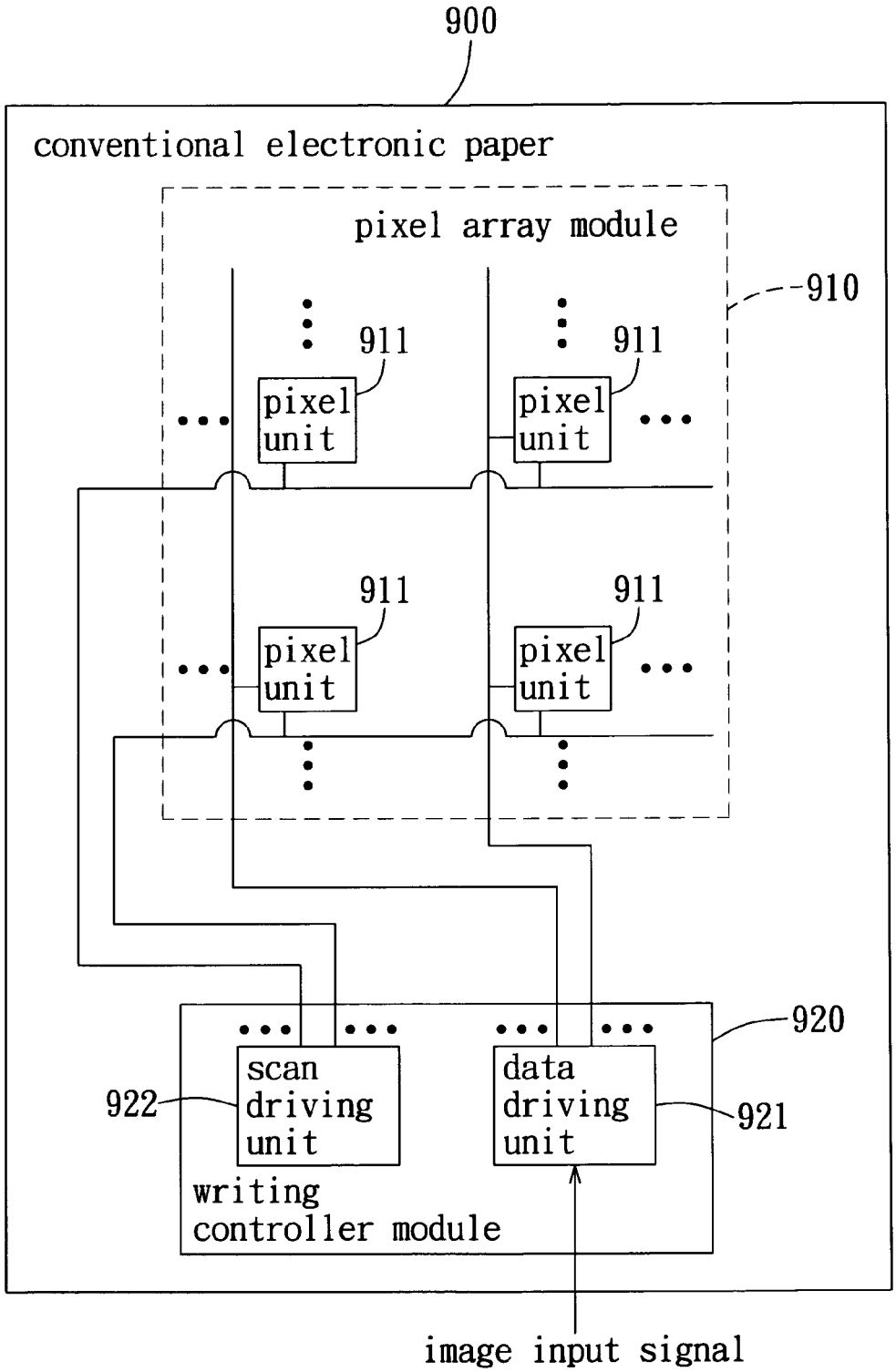
FIG. 1 PRIOR ART
FIG. 1 is a schematic block diagram of a conventional electronic paper.
Figure 2:
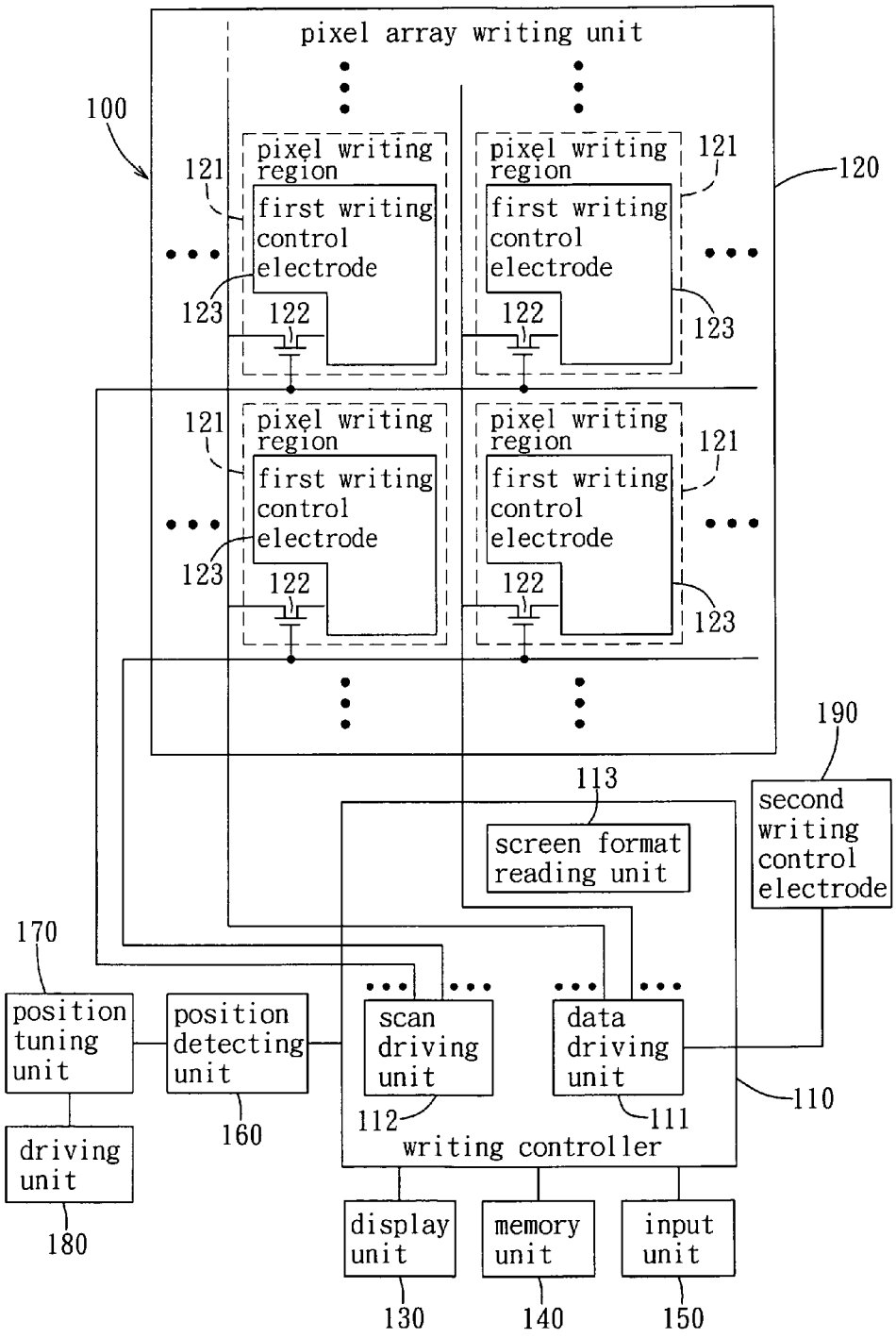
FIG. 2 is a system block diagram of the first embodiment of a writing apparatus according to the present invention.
Figure 3:
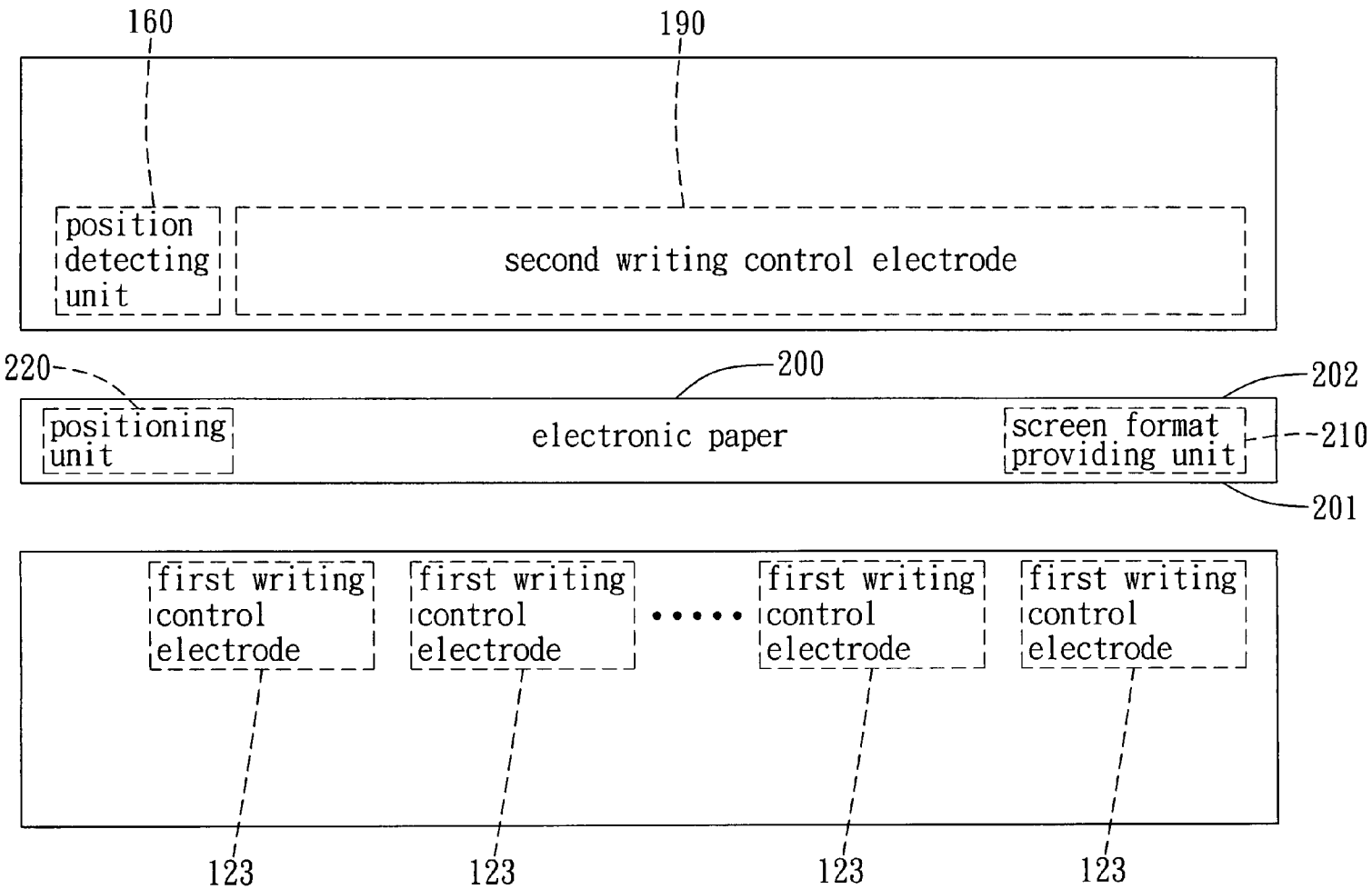
FIG. 3 is a fragmentary schematic diagram of the first embodiment for illustrating positional relationships between the electronic paper and first and second writing control electrodes of the writing apparatus when performing the writing operation on the electronic paper.

Referring to FIG. 2 and FIG. 3, the first embodiment of a writing apparatus 100 according to the present invention includes a writing controller 110, a pixel array writing unit 120 coupled electrically to the writing controller 110, a display unit 130 coupled electrically to the writing controller 110, a memory unit 140 coupled electrically to the writing controller 110, an input unit 150 coupled electrically to the writing controller 110, a position detecting unit 160 coupled electrically to the writing controller 110, a position tuning unit 170 coupled electrically to the position detecting unit 160, and a driving unit 180 coupled electrically to the position tuning unit 170.

The writing controller 110 includes a data driving unit 111 for providing a plurality of data signals, a scan driving unit 112 for providing a plurality of scan signals, and a screen format reading unit 113.

The pixel array writing unit 120 includes a plurality of pixel writing regions 121, each of which has a transistor 122 and a first writing control electrode 123. The transistor 122 has a first terminal coupled electrically to the data driving unit 111 for receiving a corresponding one of the data signals therefrom, a gate coupled to the scan driving unit 112 for receiving a corresponding one of the scan signals therefrom, and a second terminal coupled electrically to the first writing control electrode 123. The transistor 122 is controlled by the corresponding one of the scan signals to feed the corresponding one of the data signals into the first writing control electrode 12.

The writing apparatus 100 is adapted for performing a writing operation on an electronic paper 200. The writing controller 110 is utilized for controlling and managing the writing operation. The pixel array writing unit 120 uses the data signals and the scan signals to perform the writing operation on the electronic paper 200 under the control of the writing controller 110.

The pixel array writing unit 120 is adapted to be disposed to confront a first planar side 201 of the electronic paper 200 for performing the writing operation on the electronic paper 200 as controlled by the writing controller 110, where the data signals are written into the electronic paper 200 with reference to the scan signals so as to enable the electronic paper 200 to display a corresponding image.

The writing apparatus 100 further includes a second writing control electrode 190. The data driving unit 111 provides a common voltage. The second writing control electrode 190 is coupled electrically to the data driving unit 111 for receiving the common voltage therefrom.

The second writing control electrode 190 is adapted to be disposed to confront a second planar side 202 of the electronic paper 200 opposite to the first planar side 201 such that the data signals are written into the electronic paper 200 with reference to the scan signals and the common voltage for the electronic paper 200 to display the corresponding image.

In other words, as illustrated in FIG. 3, according to this embodiment, to perform the writing operation on the electronic paper 200, the electronic paper 200 is to be disposed between the pixel array writing unit 120 and the second writing control electrode 190.

In a modified implementation of this embodiment (not shown) in the absence of the second writing control electrode 190, each of the pixel writing regions 121 of the writing apparatus 100 may include a first transistor, a second transistor and a pair of writing control electrodes. The first and second transistors are used for controlling two corresponding data signals to be respectively written into the two writing control electrodes so as to perform the writing operation on the electronic paper 200. For this kind of implementation, all of the writing control electrodes are disposed on a same lateral side of the electronic paper 200 when performing the writing operation on the electronic paper 200. Since the circuitry of the pixel writing regions 121 of this embodiment is well known to those skilled in the art, further details of the same are omitted herein for the sake of brevity.

The display unit 130 is coupled electrically to the writing controller 110 for displaying a current status (e.g., operating command, operating progress) of the writing operation as controlled by the writing controller 110. The memory unit 140 is coupled electrically to the writing controller 110 for storing the data signals and for providing a memory space needed for the writing controller 110 to control the writing operation. The input unit 150 is coupled electrically to the writing controller 110 for permitting input of a writing command and the data signals.

The screen format reading unit 113 is adapted for reading a screen format that corresponds to the electronic paper 200 and that is provided by a screen format providing unit 210 of the electronic paper 200. The writing controller 110 controls the writing operation with reference to the screen format read thereby. The screen format may include information such as a size and resolution of the electronic paper 200, a writing speed supported by the electronic paper 200, etc. Communication between the screen format reading unit 113 of the writing apparatus 100 and the screen format providing unit 210 of the electronic paper 200 can be established via wired or wireless transmission. The screen format reading unit 113 can be an identification reading unit (e.g., a radio frequency identification (RFID) reader) while the screen format providing unit 210 can be an identification tag (e.g., an RFID tag).

The position detecting unit 160 is adapted for generating a positioning signal by detecting a positioning unit 220 of the electronic paper 200. The writing controller 110 is operable to initiate the writing operation on the electronic paper 200 when the positioning signal indicates that the electronic paper 200 is properly placed relative to the pixel array writing unit 120.

The driving unit 180 is adapted for driving movement of the electronic paper 200. The position tuning unit 170 is coupled electrically to the position detecting unit 160 and the driving unit 180 for controlling the driving unit 180 to drive the movement of the electronic paper 200 when the positioning signal generated by the position detecting unit 160 indicates that the placement of the electronic paper 200 relative to the pixel array writing unit 120 deviates from an ideal placement until the positioning signal indicates that the electronic paper 200 is properly placed relative to the pixel array writing unit 120 in order to permit initiating of the writing operation on the electronic paper 200. The driving unit 180 may be implemented as a motor-and-wheel/roller combination (not shown).

In another implementation of this embodiment, the position tuning unit 170 is coupled electrically to the position detecting unit 160 and the pixel array writing unit 120 for tuning positions of the first writing control electrodes 123 of the pixel array writing unit 120 when the positioning signal generated by the position detecting unit 160 indicates that the placement of the electronic paper 200 relative to the pixel array writing unit 120 deviates from an ideal placement until the writing operation on the electronic paper 200 can be properly performed. In this kind of implementation, the driving unit 180 can be omitted.

To summarize, the first embodiment of the writing apparatus 100 according to the present invention is adapted to perform a writing operation on an electronic paper 200 (or a display device incorporating the electronic paper 200) which does not have a built-in writing controller.

Figure 4:
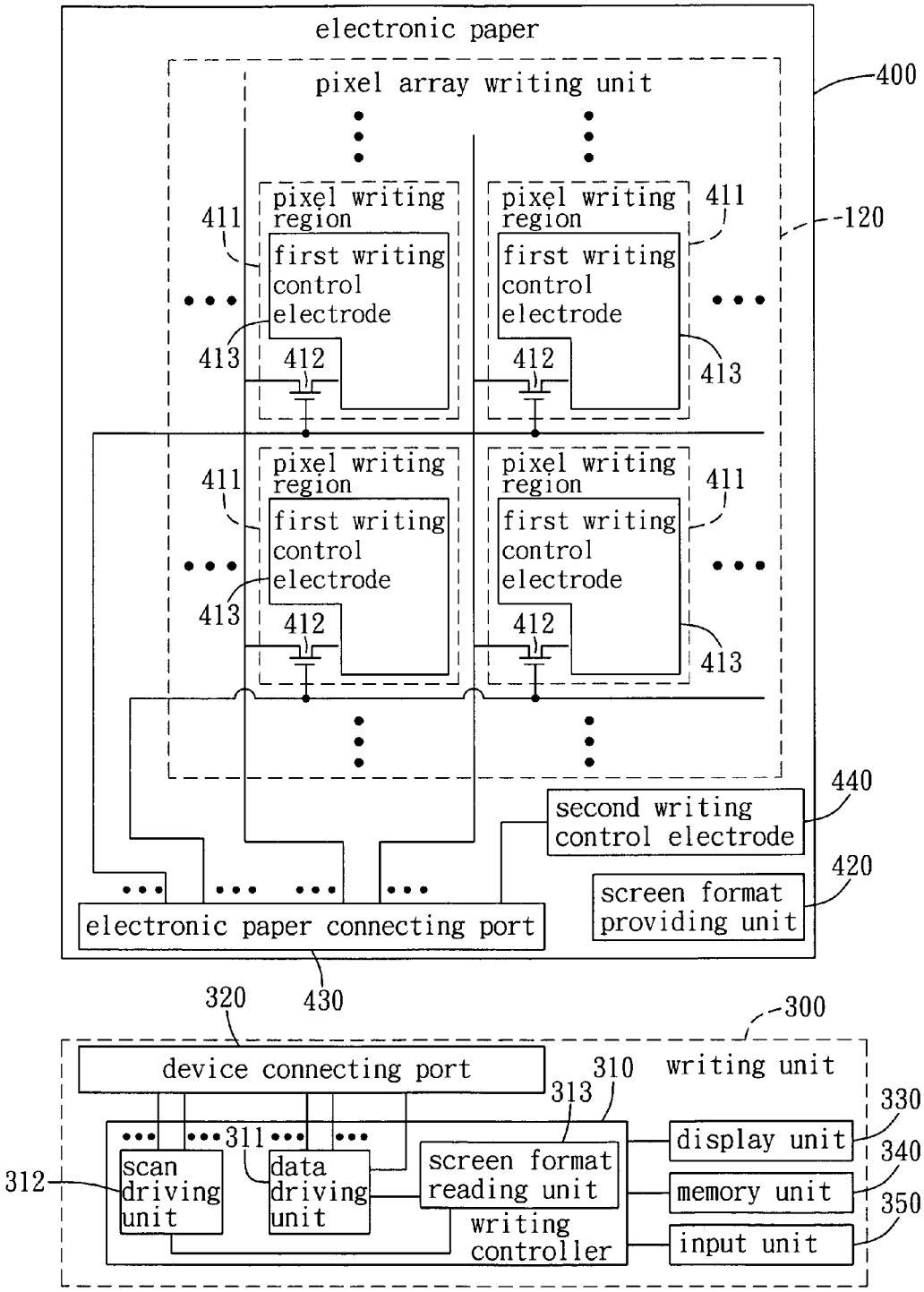
FIG. 4 is a system block diagram of the second embodiment of a writing apparatus according to the present invention.

Referring to FIG. 4, the second embodiment of a writing apparatus 300 for performing a writing operation on an electronic paper 400 includes a writing controller 310, a device connecting port 320 coupled electrically to the writing controller 310, a display unit 330 coupled electrically to the writing controller 310, a memory unit 340 coupled electrically to the writing controller 310, and an input unit 350 coupled electrically to the writing controller 310.

The electronic paper 400 includes a pixel array unit 410 with a plurality of pixel units 411, a screen format providing unit 420 and an electronic paper connecting port 430. Each of the pixel units 411 includes a transistor 412 and a first writing control electrode 413.

The writing controller 310 includes a data driving unit 311 coupled electrically to the device connecting port 320, a scan driving unit 312 coupled electrically to the device connecting port 320, and a screen format reading unit 313. The data driving unit 311 is used to provide a plurality of data signals. The scan driving unit 312 is used to provide a plurality of scan signals.

The transistor 412 has a first terminal for receiving a corresponding one of the data signals from the data driving unit 311, a gate for receiving a corresponding one of the scan signals from the scan driving unit 312, and a second terminal coupled electrically to the first writing control electrode 413. The transistor 412 is controlled by the corresponding one of the scan signals to feed the corresponding one of the data signals to the first writing control electrode 913. In other words, the data signals are written into the first writing control electrodes 413 of the electronic paper 400 with reference to the scan signals so as to enable the electronic paper 400 to display a corresponding image.

In this embodiment, the device connecting port 320 is coupled electrically to the data driving unit 311 and the scan driving unit 312, and serves as an interface for connecting with the electronic paper connecting port 430 of the electronic paper 400 such that the data signals and the scan signals are fed into the electronic paper 400.

The electronic paper 400 may further include a second writing control electrode 440 coupled electrically to the electronic paper connecting port 430 for receiving a common voltage from the data driving unit 311 of the writing apparatus 300 via the connection/communication between the electronic paper connecting port 430 and the device connecting port 320. The data signals are written into the electronic paper 400 with reference to the scan signals and the common voltage for the electronic paper 400 to display the corresponding image.

In a modified implementation of this embodiment (not shown), the electronic paper 400 may omit the second writing control electrode 440, while each pixel unit 411 has a first transistor, a second transistor and a pair of writing control electrodes. The first and second transistors are used for controlling two corresponding data signals to be respectively written into the two writing control electrodes so as to perform the writing operation. In this kind of implementation, the writing operation is performed on the electronic paper 400 when all of the writing control electrodes are disposed on a same lateral side of the electronic paper 400. Since the circuitry of the pixel units 411 is well known to those skilled in the art, further details of the same are omitted herein for the sake of brevity.

As with the previous embodiment, the screen format reading unit 313 is adapted for reading a screen format that corresponds to the electronic paper 400 and that is provided by the screen format providing unit 420 of the electronic paper 400. The writing controller 310 controls the writing operation with reference to the screen format read thereby. The screen format may include information such as a size and resolution of the electronic paper 400, a writing speed supported by the electronic paper 400, etc. Communication between the screen format reading unit 313 of the writing apparatus 300 and the screen format providing unit 420 of the electronic paper 400 can be established via wired or wireless transmission. The screen format reading unit 313 may be an identification reading unit (e.g., a radio frequency identification (RFID) reader) while the screen format providing unit 420 may be an identification tag (e.g., an RDID tag).

To summarize, the second embodiment of the writing apparatus 300 according to the present invention is adapted to perform a writing operation on an electronic paper 400 (or a display device incorporating the electronic paper 400) which is provided with writing control electrodes (e.g., the first writing control electrodes 413 and the second writing control electrode 440 as described above with reference to FIG. 4), but which does not have a built-in writing controller.

In conclusion, with the writing apparatus 100, 300 of the present invention, the electronic paper 200, 400 may form a display device without requiring a built-in writing controller, such that the fabrication cost for such display devices can be significantly reduced, and the flexibility of such display devices can be enhanced.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A writing apparatus adapted for performing a writing operation on an electronic paper, said writing apparatus comprising:

a writing controller including:

a data driving unit for providing a plurality of data signals, and a scan driving unit for providing a plurality of scan signals;

a pixel array writing unit coupled electrically to said data driving unit and said scan driving unit, and adapted to be disposed to confront a first planar side of the electronic paper for performing the writing operation on the electronic paper as controlled by said writing controller, where the data signals are written into the electronic paper with reference to the scan signals so as to enable the electronic paper to display a corresponding image;

a position detecting unit adapted for generating a positioning signal by detecting a positioning unit of the electronic paper, said writing controller being operable to initiate the writing operation when the positioning signal indicates that the electronic paper is properly placed relative to said pixel array writing unit;

a physical driving unit adapted to physically move the electronic paper relative to the pixel array writing unit; and a position tuning unit coupled electrically to said position detecting unit and said physical driving unit for controlling said physical driving unit to physically move the electronic paper when the positioning signal generated by said position detecting unit indicates that placement of the electronic paper relative to said pixel array writing unit deviates from an ideal placement until the positioning signal indicates that the electronic paper is properly placed relative to said pixel array writing unit in order to permit initiating of the writing operation on the electronic paper.

2. The writing apparatus as claimed in claim 1, further comprising a display unit coupled electrically to said writing controller for displaying a current status of the writing operation as controlled by said writing controller.

3. The writing apparatus as claimed in claim 1, further comprising a memory unit coupled electrically to said writing controller for storing the data signals and for providing a memory space needed for said writing controller to control the writing operation.

4. The writing apparatus as claimed in claim 1, further comprising an input unit coupled electrically to said writing controller for permitting input of a writing command and the data signals.

5. The writing apparatus as claimed in claim 1, the electronic paper including a screen format providing unit for providing a screen format corresponding to the electronic paper, wherein said writing controller further includes a screen format reading unit adapted for reading the screen format from the screen format providing unit of the electronic paper, said writing controller controlling the writing operation with reference to the screen format read thereby.

6. The writing apparatus as claimed in claim 1, wherein said pixel array writing unit includes a plurality of pixel writing regions, each of which includes a transistor and a first writing control electrode, said transistor having a first terminal coupled electrically to said data driving unit for receiving a corresponding one of the data signals therefrom, a gate terminal coupled to said scan driving unit for receiving a corresponding one of the scan signals therefrom, and a second terminal coupled electrically to said first writing control electrode.

7. The writing apparatus as claimed in claim 6, further comprising a second writing control electrode, said data driving unit further providing a common voltage, said second writing control electrode being coupled electrically to said data driving unit for receiving the common voltage therefrom;

wherein said second writing control electrode is adapted to be disposed to confront a second planar side of the electronic paper opposite to the first planar side such that the data signals are written into the electronic paper with reference to the scan signals and the common voltage for the electronic paper to display the corresponding image.

* * * * *